343-700 MS AU 254 EX
5/31/83 OR 4,386,357

343/700MS United States Patent [19]
Patton

[11] 4,386,357
[45] May 31, 1983

[54] PATCH ANTENNA HAVING TUNING MEANS FOR IMPROVED PERFORMANCE

[75] Inventor: Paul D. Patton, Denver, Colo.

[73] Assignee: Martin Marietta Corporation, Bethesda, Md.

[21] Appl. No.: 265,962

[22] Filed: May 21, 1981

[51] Int. Cl.[3] ..... H01Q 1/38
[52] U.S. Cl. ..... 343/700 MS
[58] Field of Search ..... 343/700 MS, 829, 830, 343/846

[56] References Cited

U.S. PATENT DOCUMENTS 3,680,136 7/1972 Collings ..... 343/700 MS
4,053,895 10/1977 Malagisi ..... 343/700 MS

*Primary Examiner*—Eli Lieberman
*Attorney, Agent, or Firm*—Yount & Tarolli

[57] ABSTRACT

A patch antenna employing a matching stub for improved performance. The patch antenna comprises a conductive patch disposed closely over a ground plane, having a shorting pin shorting the conductive patch to the ground plane at a central point and a coaxial feed line attached to the conductive patch at a point between the shorting pin and the edge of the patch for conducting electromagnetic energy to or from the conductive patch. The matching stub comprises a conductive member extending at least partially between the ground plane and the conductive patch at a point located on the opposite side of the shorting pin from the feed line. Performance is further improved by leaving only a small portion of the inner conductor of the coaxial feed line uncovered by the outer conductor.

11 Claims, 4 Drawing Figures

PATCH ANTENNA HAVING TUNING MEANS FOR IMPROVED PERFORMANCE

BACKGROUND AND FIELD OF THE INVENTION

The present invention relates to patch antennas, and more particularly to an improved patch antenna utilizing matching means for improving the performance thereof.

One known form of antenna, known as a patch antenna, utilizes a planar patch of conductive material disposed parallel to a ground plane and separated therefrom by a thin dielectric layer. A feed is provided to communicate electromagnetic energy to or from the patch, and a shorting pin shorts the center area of the patch to the ground plane through the dielectric so as to fix the center of the patch at a ground potential. Antennas of this nature may be inexpensively manufactured and may be readily formed into low cost, light weight phased array antenna systems.

One difficulty with patch antennas is their narrow bandwidth. In patch antennas previously reported, the bandwidth of the antenna was as narrow as one or two percent of the center frequency of the antenna. Although in theory the bandwidth of the antenna should increase as the dielectric layer separating the patch from the ground plane is increased in thickness, the actual results produced by increasing the dielectric thickness have in the past fallen short of theory. Increasing the dielectric thickness actually further narrowed the bandwidth of the antenna, while also substantially increasing the mismatch between the antenna and the feed, producing inefficient operation.

SUMMARY OF THE INVENTION

There is disclosed herein a patch antenna employing a tuning stub for improving the performance thereof whereby a thick dielectric patch antenna may be constructed employing the tuning stub to provide performance near the theoretical levels. In accordance with the present invention, the tuning stub comprises matching means including a conductive member extending at least partially between the ground plane and the radiating patch and located at a position on the patch which is on the opposite side of the shorting pin from the feed means.

It has been found that the antenna can be tuned through use of this matching stub so that the antenna provides reduced VSWR and substantially increased bandwidth. If used in a circularly polarized patch antenna, improved circularity results. Moreover, this technique can be used on thin dielectric patch antennas to improve the pattern response thereof.

BRIEF DESCRIPTION OF THE DRAWINGS

The foregoing and other aspects and advantages of the present invention will become more readily apparent from the following detailed description, as taken in conjunction with the accompanying drawings, wherein.

DETAILED DESCRIPTION

Figure 1:
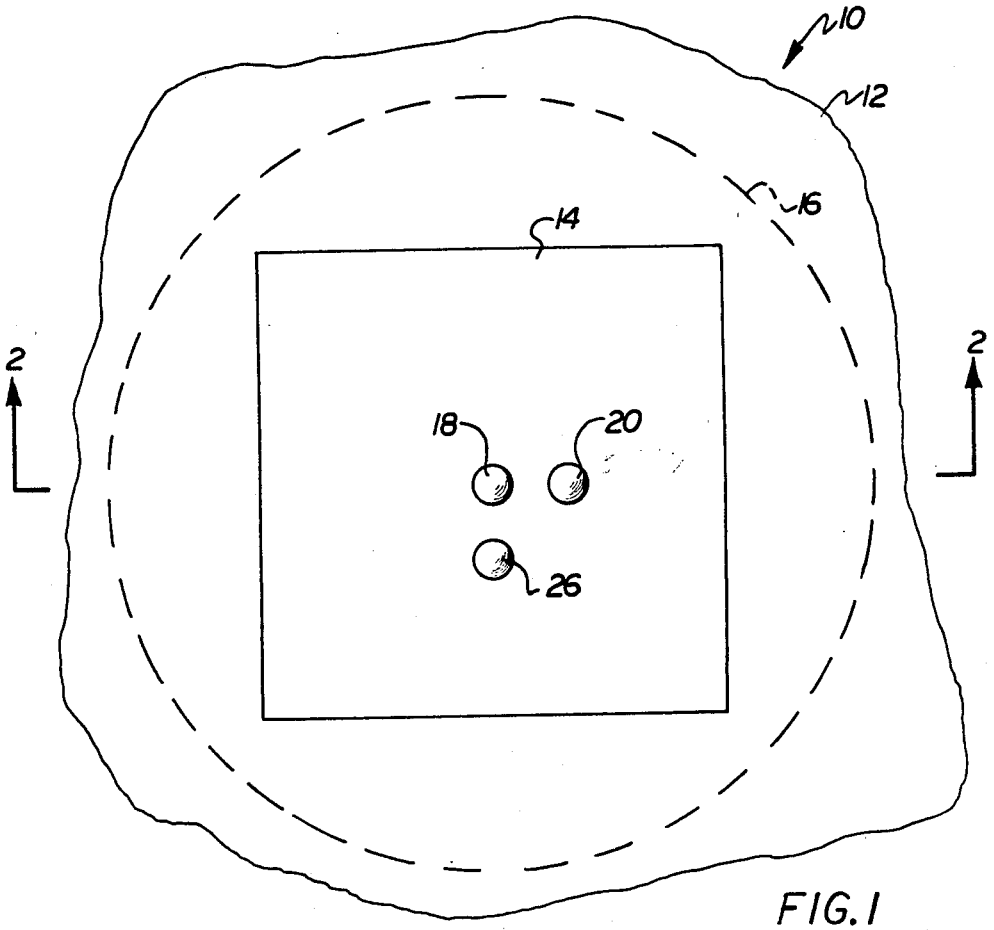
FIG. 1 (PRIOR ART)
FIG. 1 is a plan view of a prior art patch antenna.
Figure 2:
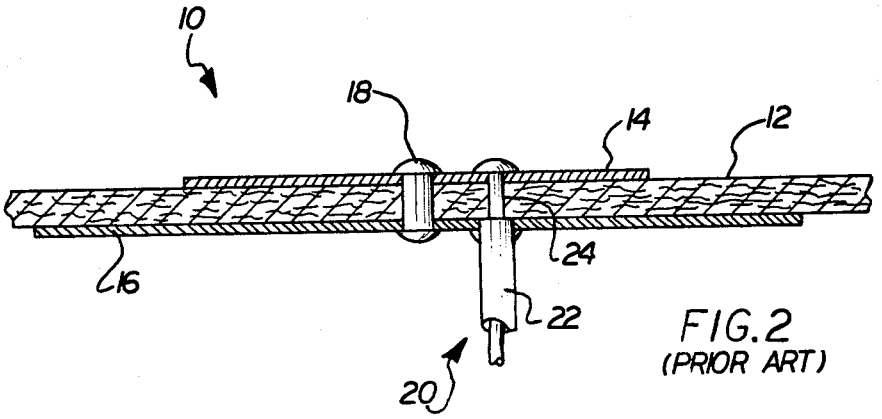
FIG. 2 (PRIOR ART)
FIG. 2 is a sectional elevation view of the prior art patch antenna of FIG. 1.

FIGS. 1 and 2 are plan and elevation views, respectively, of a prior art circularly polarized patch antenna. As shown in these Figures, the patch antenna 10 includes a planar sheet of dielectric material 12 separating two sheets of conductive material 14 and 16. The sheet 14 located on one surface of the dielectric material 12 is formed in a generally square shape and serves as the radiating "patch" of the antenna. The second conductive sheet 16, formed on the opposite side of the dielectric 12 from the patch 14, has a generally circular configuration and is aligned in registration with the patch 14. The sheet 16 represents the ground plane of the patch antenna, and is spaced from the radiating patch 14 by only a short distance representing the thickness of the dielectric 12. The dielectric 12 maintains the patch 14 and ground plane 16 in a substantially parallel relationship with respect to one another.

The two conductive sheets are shorted together at a central location therealong by means of a conductive shorting pin 18 which passes through the dielectric and is soldered to both the radiating patch 14 and the ground plane 16. The purpose of this pin is to ground the center of the patch.

The feeding of the patch antenna illustrated in FIGS. 1 and 2 is accomplished by means of a semirigid coaxial cable 20 having inner and outer conductors separated by a dielectric material. Its outer conductor 22 is soldered to the ground plane 16 and its inner conductor 24 is soldered to the radiating patch 14. Conventionally, the outer conductor 22 of the semirigid coaxial cable 20 will be stripped away from the end portion thereof so that only the center conductor 24 protrudes through the dielectric material 12.

The inclusion of a single feed will result in the antenna being linearly polarized. Thus, if electromagnetic energy is fed to a single feed, such as the feed 20, linearly polarized electromagnetic radiation will be radiated from the patch. The circularly polarized patch antenna illustrated in FIGS. 1 and 2 employs a second feed 26 substantially identical to the first feed, but rotated 90° therefrom about the shorting pin 18 so that the linearly polarization excited by that feed is perpendicular to the linear polarization excited by the first feed 20. The two feeds 20 and 26 are fed with RF signals which are 90° out of phase with one another, thus circularly polarized electromagnetic radiation is produced by the antenna.

Known patch antennas such as those described with respect to FIGS. 1 and 2 have relatively narrow bandwidths, usually on the order of one or two percent of the center frequency of the patch antenna. It is known that theoretically the bandwidth of the patch antenna can be increased by increasing the thickness of the dielectric 12, thereby increasing the separation between the two parallel conductive sheets 14 and 16. In practice, however, the increase in thickness of the dielectric does not secure the result promised by theory. Instead, thick dielectric patch antennas have been found to exhibit not only very narrow bandwidth, but also high VSWR.

Figure 3:
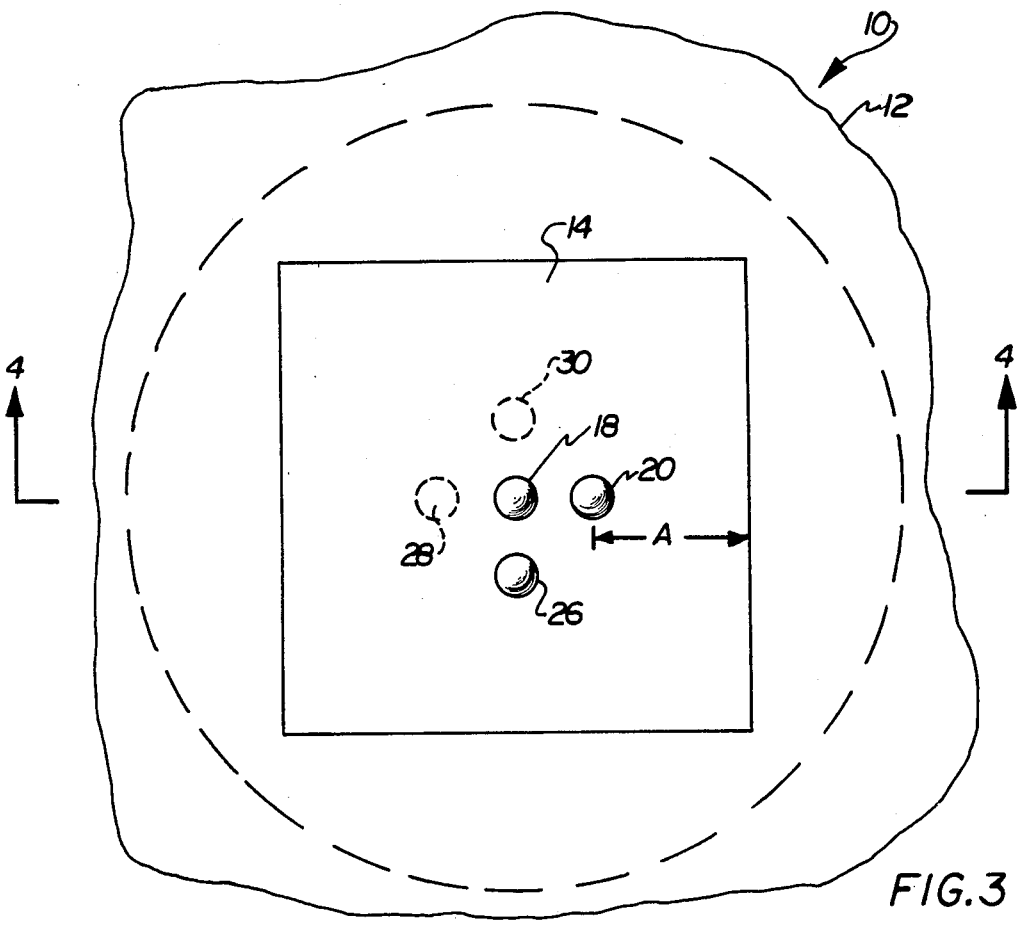
FIG. 3 is a plan view of a patch antenna employing the concepts of the present invention; and, FIG. 4 is a sectional elevation view of the patch antenna of FIG. 3.
Figure 4:
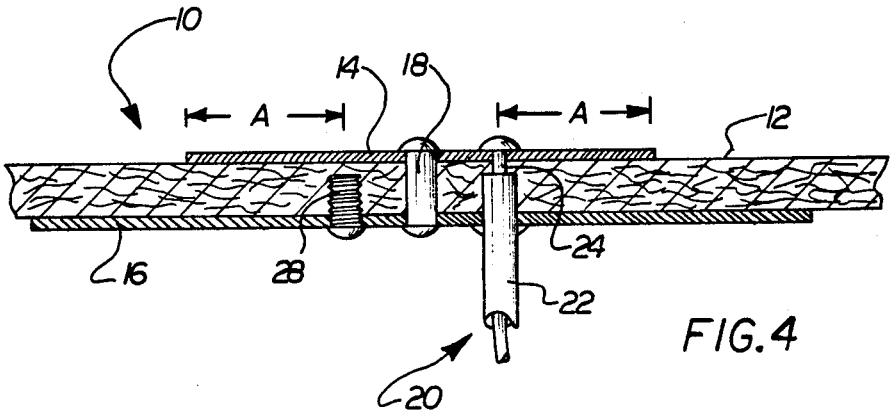

The patch antenna of FIGS. 1 and 2, as modified in accordance with the teachings of the present invention, is shown in FIGS. 3 and 4. In FIGS. 3 and 4 the patch antenna 10 is again shown as including a generally square conductive patch 14 spaced from a ground plane 16 by a dielectric material 12. In the embodiment of FIGS. 3 and 4, the dielectric 12 separating the radiating patch 14 from the conductive ground plane 16 is thicker to broaden the bandwidth of operation of the bandwidth antenna. This results in an increased mismatch between the coaxial feed lines 20 and 26 and the patch antenna, producing excessive VSWR, and leading to inefficiency in the operation of the antenna.

It has now been found that the high return losses associated with this thick dielectric patch antenna are in part due to the length of the bare center conductor of the coaxial cable 20 which extends between the ground plane 16 and the radiating patch 14. This portion of the center conductor 24 acts as an inductor in series with the feed of the antenna; the greater its length the greater the inductance.

In accordance with one aspect of the present invention, the inductance associated with this portion of the center conductor 24 is reduced by reducing the portion thereof which is stripped of its outer sheath. This can perhaps best be seen in FIG. 4. To accomplish this, the dielectric is first drilled out to permit the outer jacket 22 of the coaxial cable 20 to pass into the dielectric material, and approach the radiating patch 14 more closely than had been permitted in the past. As before, the outer conductor 22 is soldered to the ground plane 16 at the point at which it passes through the ground plane. It has been found that this materially improves the return loss of this thick dielectric patch antenna. The feed 26 for the other polarization is treated similiarly.

In accordance with another aspect of the present invention, the performance characteristics of the thick dielectric patch antenna are further improved by including an "image" tuning stub to simulate and balance the effect of the semirigid coaxial feed to the patch surface. As can perhaps best be seen in FIG. 4, this tuning stub 28 is inserted through the ground plane 16 at a point on the opposite side of the shorting pin 18 from the feed cable 20, and is equally spaced therefrom. The tuning stub 28 and feed 20 are therefore located at equal distances "A" from their corresponding edge of the patch. The tuning stub is formed of some conductive material, such as brass, and in the illustrated embodiment is cylindrical in shape, having a cross sectional diameter which is substantially the same as that of the coaxial feed line 20.

Preferably, the opening in the dielectric material 12 and the ground plane 16 into which the tuning stub is inserted is tapped so that the tuning stub 28 may be threadedly received thereby. The extent of insertion of the tuning stub into the dielectric material, and thus the extent to which the stub bridges the distance between the ground plane 16 and patch 14, may then be conveniently adjusted by simply screwing the tuning stub into or out of the material. The center frequency of the antenna varies with the extent of insertion of the tuning stub 28 in the dielectric material. The antenna can therefore be tuned by simply adjusting the depth of the tuning stub. Once the desired performance is achieved, the tuning stub is permanently fastened in place by soldering it to the ground plane 16.

The reduction in the length of the bare center conductor and the addition of the tuning stub substantially improve the return loss performance of the thick dielectric patch antenna. In a thick dielectric patch antenna lacking the tuning stub and having the outer conductor of its coaxial feed line stripped away as in the prior art, return loss was found to be approximately 6 dB below the worst case, or shorted-line condition. This represents an impedance mismatch of approximately 3:1. When the exposed portion of the center conductor 24 was minimized as illustrated in FIG. 4, the return loss was improved to 9 dB below worst case, representing a mismatch of approximately 2:1. When a tuning stub was then added to the same antenna, however, return loss was dramatically improved to 26 dB below worst case at the center frequency of the antenna. This represents an impedance match of close to 1:1 In addition, bandwidth was increased to in excess of 10% of the center frequency.

In the embodiment shown in FIGS. 3 and 4, the patch antenna is again circularly polarized. It has been found that the tuning stub 28 provided to match the feed 20 of one linear polarization has essentially no effect on the other linear polarization (produced by the second feed 26). Consequently, to improve the performance of the other linear polarization and thus the circular polarization response of the antenna, a second tuning stub 30 is added on the opposite side of the shorting pin 18 from the feed 26, again spaced from the edge of the patch antenna by the same distance "A" at which the feed 26 is spaced from its closest edge.

The inclusion of the tuning stubs provides a noticeable improvement in the circular response of this type of antenna. Without the stubs, the axial ratio of the antenna is degraded across a portion of its primary radiating sphere. With the tuning stubs, however, the axial ratio of the antenna is nearly constant over its band of operation and over the primary sphere of radiation.

Although the invention has been described with respect to a preferred embodiment, it will be appreciated that various rearrangements and alteration of parts may be made without departing from the spirit and scope of the present invention, as defined in the appended claims.

What is claimed is:

1. In a patch antenna comprising a planar conductive patch disposed closely over a ground plane, having shorting means shorting the conductive patch to the ground plane at a central point and feed means attached to the conductive patch at a point between the shorting means and the edge of the patch for conducting electromagnetic energy to or from said conductive patch, the improvement comprising passive matching means for tuning said antenna to improve its performance, said matching means comprising a conductive member extending at least partially between said ground plane and said conductive patch at a point located on the opposite side of said shorting means from said feed means.

2. The improvement of claim 1 wherein said feed means and said passive matching means are positioned along said conductive patch such that said shorting means is disposed substantially midway between them.

3. The improvement of claim 1, wherein said feed means comprises a coaxial transmission line extending through said ground plane, the center conductor being electrically attached to said conductive patch and the outer conductor being electrically attached to said ground plane.

4. The improvement of claim 3, wherein said outer conductor protrudes through said ground plane and extends part of the distance to said conductive patch whereby the portion of unsheathed inner conductor is shorter than the distance separating said conductive patch and said ground plane.

5. The improvement of claim 3, wherein said conductive member comprises a cylinder of conductive material having substantially the same cross sectional diameter as said coaxial transmission line.

6. The improvement of claim 5, wherein said cylinder is threaded and is screwed through said ground plane towards said conductive patch.

7. The improvement of claim 1, wherein said conductive member is electrically shorted to said ground plane and extends from said ground plane towards said conductive patch.

8. The improvement of claim 7, wherein said feed means and said passive matching means are positioned along said conductive patch such that said shorting means is disposed substantially midway between them.

9. The improvement of claim 8, wherein said feed means and said passive matching means are positioned along said conductive patch equal distances from corresponding edges of said conductive patch.

10. The improvement of claim 1, wherein said passive matching means further includes means enabling adjustment of the extent to which said conductive member bridges the distance between said conductive patch and said ground plane.

11. The improvement of claim 10, wherein said conductive member is substantially cylindrical in shape and said adjustment enabling means comprises threads formed on the outer surface of said member and cooperating threads on the inner surface of a correspondingly sized opening in one of said conductive patch or ground plane, permitting said member to be screwed into or out of said opening and thus permitting variation of the extent to which said conductive member bridges the distance between said conductive patch and said ground plane.

* * * * *